United States Patent [19]

Claude et al.

[11] 4,013,009

[45] Mar. 22, 1977

[54] ILLUMINATING PROJECTILES AND PYROTECHNIC DEVICES

[75] Inventors: Pierre M. R. Claude; Robert E. Gencey; Jean-Paul Mottry; René H. Cayre, all of Bourges, France

[73] Assignee: Etat Francais, France

[22] Filed: Feb. 7, 1975

[21] Appl. No.: 547,931

[30] Foreign Application Priority Data

Feb. 8, 1974 France ..... 74.04213

[52] U.S. Cl. ..... 102/35.6; 244/3.27

[51] Int. Cl.[2] ..... F42B 13/40

[58] Field of Search ..... 102/34.1, 35, 35.6, 102/37.1, 60, 63, 87; 244/3.27

[56] References Cited

UNITED STATES PATENTS

| | | | |
|---|---|---|---|
| 3,702,588 | 11/1972 | Simmons | 102/35.6 |
| 3,719,146 | 3/1973 | Thurston | 102/35.6 |
| 3,719,339 | 3/1973 | Simmons et al. | 102/35.6 |
| 3,730,099 | 5/1973 | Schopp | 102/35.6 |

*Primary Examiner*—Verlin R. Pendegrass
*Attorney, Agent, or Firm*—Stevens, Davis, Miller & Mosher

[57] ABSTRACT

An illuminating projectile which can be launched from a rifled-tube unit.

The projectile includes on the one hand an illuminating flare which can be disconnected from the body of the projectile after a predetermined period of time under the action of an ejection charge, and on the other hand at least one parachute for braking translation of the illuminating flare, and floating fins acting on the illuminating flare itself to reduce the speed of rotation of the illuminating flare. The floating fins are connected to the illuminating flare by filiform connecting elements, one of the ends of which is attached to the illuminating flare while the other end is free and provided with a stop, the fins being mounted for free rotation and translation around and along a connecting element.

13 Claims, 8 Drawing Figures

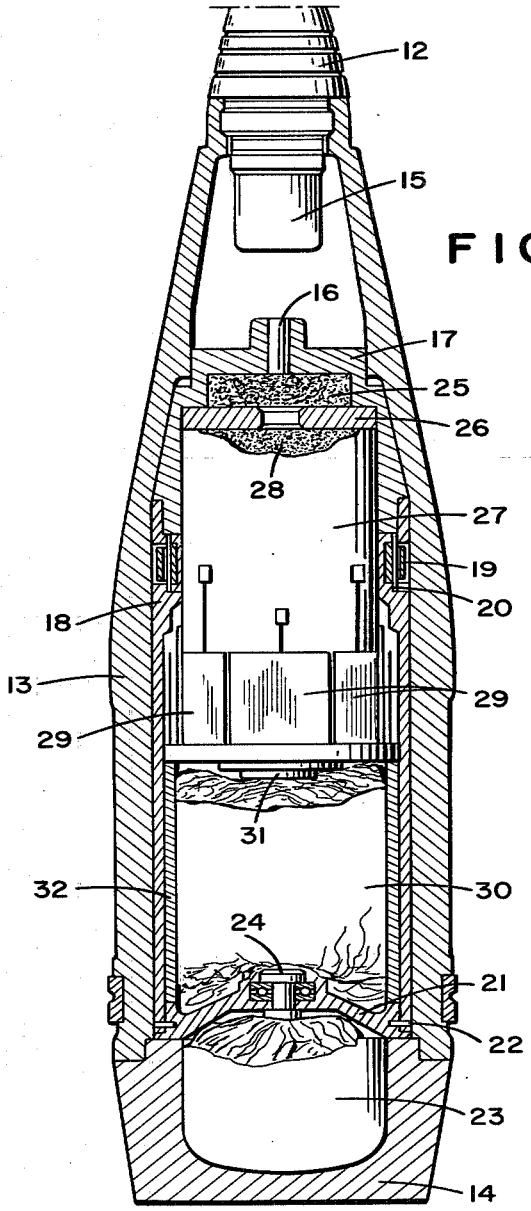
FIG. 2
FIG. 3
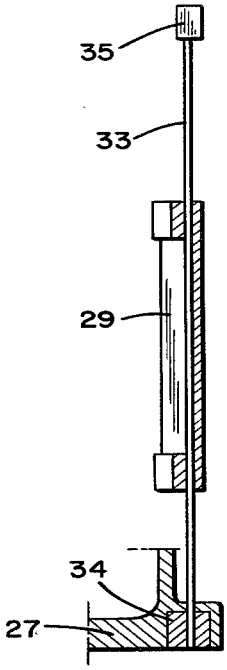

ILLUMINATING PROJECTILES AND PYROTECHNIC DEVICES

The present invention relates to the field of illuminating projectiles and pyrotechnic devices, particularly for observing the results of artillery fire, which are launched from rifled-tube equipment.

To these projectiles, which are generally referred to as illuminating shells, are imparted a high speed of rotation in order to assure their stability on their trajectory. These shells employ at least one ejection charge; at a predetermined point of their trajectory, an illuminating unit, formed essentially of a parachute and of an illuminating flare suspended from the parachute, is released from the body of the shell. A parachute and the illuminating flare then have a high residual speed of rotation. While the parachute stabilizes itself rapidly due to its large lift surface, this is not true of the illuminating flare. This rotation, in fact, is harmful to the performance of the shell.

The present invention, more particularly, is concerned with a device intended rapidly to decelerate the speed of rotation of the illuminating flare.

Embodiments of this type are known and applied to shells operating with double flare removal, as described below.

In a first type of known shell, at the end of a timing period, a first ejection charge separates from the body of the shell a cylindrical container containing illuminating elements and parachutes while, via a delay charge, a second ejection charge frees the illuminating flare itself from the container, the flare being braked in its movement of translation by a parachute. The braking in rotation is exerted only on the container by means of fins welded on the container. This braking continues for about 8 seconds, after which the second ejection charge frees the illuminating flare which is free in rotation.

In this first type of shell, the deceleration is applied for a relatively long period of time and constitutes a practical handicap, since it is necessary to cause the first ejection at a high altitude.

In a second known type of shell of similar operation, a first ejection charge, under the combined action of an extractor parachute, separates the body of the shell from a cylindrical container comprising in particular an illuminating flare and a parachute. This container is decelerated in rotation. A second ejection charge frees the illuminating flare, the base of which bears a part for the fastening of a main parachute, the part having sectors on which there are fastened small fins which are intended to decelerate the assembly in rotation. The sectors are released about 1.8 seconds after the first ejection and are moved apart by the residual rotation of the assembly. The deceleration is not complete since the surface action of the fins is small and they act only for a rather short period of time.

In both of the cases mentioned above, the braking of rotation acts on a large mass; it therefore lacks efficiency and the result is poorer illumination performance.

As a matter of fact, when an illuminating flare with a non-combustible covering, for instance steel which is necessary to withstand high mechanical stresses, burns and turns at the same time, the slag subjected to the effect of the centrifugal force is glued against the walls. This deposit of slag is greater the higher the speed of rotation. The phenomenon results in a substantial decrease in the efficiency of the pyrotechnic device and in particular the time of illumination. For example, tests carried out at a fixed point on a uniform series of illuminating flares have given the following results:

| | | | | | | |
|---|---|---|---|---|---|---|
| Speed of rotation (in revolutions per second) | 0 | 15 | 25 | 50 | 70 | 125 |
| Duration of illumination (in seconds) | 48 | 33 | 23 | 19 | 17 | 14 |

Moreover, the braking is due to the resistance R of the air. Neglecting friction one has:

$$R = I\frac{dw}{dt} = \frac{1}{2}\,\text{p.s.}\,\frac{a^2w^2}{4}\cdot C_x\cdot\frac{a}{2}$$

in which $I$ = the axial moment of inertia of the assembly to be braked;

$w$ = speed of rotation;

$p$ = density of the air;

$a$ = average caliber of the braking fins;

$C_X$ = drag coefficient of the fins; and $s$ = total surface of the fins.

One obtains from this:

$$I\left(\frac{1}{w}-\frac{1}{wo}\right)=p\cdot s\cdot\frac{a^3}{8}\cdot C_x\cdot t$$

It is therefore seen that, all things being otherwise equal, the braking will be better when:

1. the moment of inertia is small, that is to say the dimensions of the mass or movement are reduced;
2. the average caliber of the fins is large;
3. the time of action is long.

In practice $a$ is limited by the strength of the connections which are acted on by the centrifugal force $$F = m\,w^2\,r$$

in which $m$ is the sum of the masses of the connecting elements and of the fins; and $r$ is the distance from the axis to the center of gravity of the above elements.

As this centrifugal force is much greater than the braking resistance, the fins cannot roll around the flare. The tension key on the connecting elements is a component of the forces R and F.

It is therefore clear that it is much more profitable to act on the illuminating flare alone rather than on an assembly having a higher moment of inertia, the braking of which is furthermore not necessary from a functional viewpoint. Furthermore, if the braking fins are fixed on the flare, they may act as long as necessary, that is to say until complete stoppage. The devices which act before the liberation of the flare necessarily have a limited time of action, which is a drawback.

The object of the present invention is to provide a method of launching an illuminating projectile from a rifled-tube unit, in which method after a predetermined time an illuminating flare is released from the body of the projectile under the action of an ejection charge and thereupon the illuminating flare is braked in translation by means of at least one parachute, the method being characterized by the fact that the illuminating flare itself is acted on after it has been released from the body of the projectile by means for reducing its speed of rotation.

In accordance with the invention, the means may be formed of a plurality of floating fins connected to the illuminating flare by filiform connecting elements, preferably flexible, one of the ends of which is securely fastened to the illuminating flare while the other end is free and is provided with a stop, the fins being mounted for free rotation and translation around and along a connecting element.

Another object of the present invention is to provide a device for the reduction of the speed of rotation of the illuminating flare of an illuminating projectile launched from a rifled-tube unit, characterized by the fact that it includes a plurality of floating fins connected to the illuminating flare by flexible filiform connecting elements, one of the ends of which is secured to the illuminating flare while the other end is free, the fins being free in rotation around a connecting element and free in translation along the connecting element up to a stop fastened to the free end of the connecting element.

In one preferred embodiment, each of the fins is free in rotation and in translation with respect to a single connecting element. The connecting elements may be fastened regularly around the rear side wall of the illuminating flare.

Preferably furthermore the fins follow the curvature of the illuminating flare and can be made of an injectable plastic, for instance polyethylene, or any other easily fusable material.

The invention will be better understood from the following examples, given by way of illustration of the scope of the invention and not by limitation of it, read in conjunction with the accompanying drawing in which:

FIG. 2 is a longitudinal section through a second embodiment of a shell of 155 mm caliber, with double ejection in accordance with the invention;

FIG. 3 shows the attachment of the fins with respect to the illuminating flare of a shell in accordance with the invention;

Figure 8:
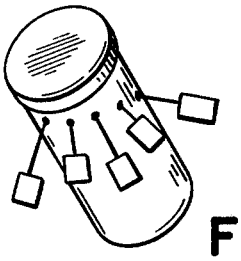

FIGS. 4 to 7 diagrammatically indicate the operation of the second embodiment of a shell in accordance with the invention; and FIG. 8 is an isometric projection showing the arrangement of the connecting elements of the fins with respect to the illuminating flare.

Figure 1:
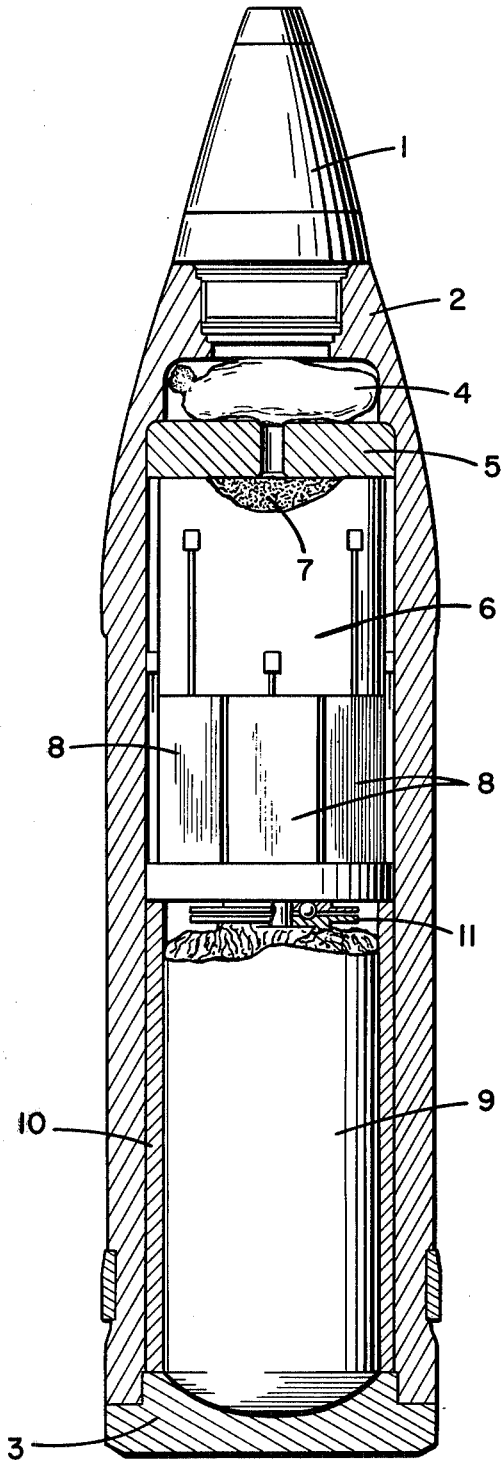
FIG. 1 is a longitudinal section through a first embodiment of a shell of 105 mm caliber, with single ejection in accordance with the invention.

The shell in accordance with the invention which is shown in FIG. 1 comprises, in particular, a fuse 1 screwed onto a body 2, a base 3 maintained by force fitting in the body 2, an ejection charge 4, a piston 5, an illuminating flare 6 charged with illuminating composition 7 and equipped with fins 8 and a parachute 9 protected by shells 10 and connected to the illuminating flare 6 by a ball bearing device 11.

The attachment of the fins is described in the second embodiment.

At the end of the timing period, the fuse 1 ignites the ejection charge 4 which in its turn ignites the illuminating composition 7. At the same time the pressure created by this ejection charge pushes against the piston 5 which empties the shell after having released the base 3 via the illuminating flare 6 and the shells 10. Upon the emergence of the shell body 2, the shells 10 move away to permit the parachute 9 to open. As soon as the fins 8 are sufficiently freed they move away and start to decelerate the rotation of the illuminating flare 6 while the latter completes its emergence. It then undergoes a double braking, namely in translation by the parachute and in rotation by the fins, while illuminating the earth. When it is braked in rotation, the fins are folded back close to the walls and fused under the effect of the heat produced by the combustion of the illuminating composition which has heated the walls.

The shell in accordance with the invention, shown in FIG. 2, comprises primarily a fuse 12 screwed onto a shell body 13, a base 14 held by friction on the body 13, a first ejection charge 15, a pyrotechnical delay 16, fastened on a container cap 17 screwed onto a container body 18 which has brakes 19 that brake the rotation of the container and are held by pins 20, and a container bottom 21 assembled to the container body 18 by pins 22. A small parachute 23 is connected to the container bottom 21 by a ball thrust bearing 24. Below the delay 16 there is a second ejection charge 25, a piston 26, and an illuminating flare 27 filled with illuminating composition 28 and equipped with floating fins 29, there being eight in the example shown. A large parachute 30 is connected to the illuminating flare 27 via ball bearing device 31 and protected by shells 32. The fastening of the fins 29 is shown in FIG. 3.

The fins slide freely in translation and in rotation on a flexible cable or filiform element 33, on end of which is clamped in a ring 34 which is imbedded in a hole drilled in the shoulder of the flare 27; at the other free end of the cable 33 there is a stop ring 35.

Figure 4:
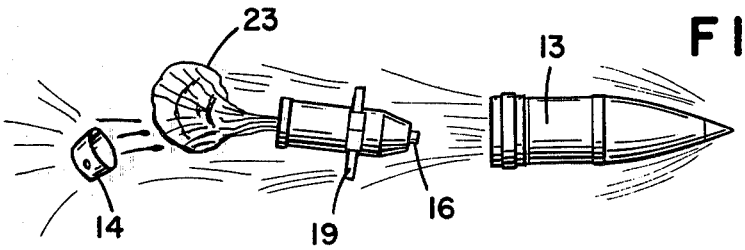

The operation of this second embodiment of a shell in accordance with the invention is as follows and is illustrated schematically in FIGS. 4 to 7. At the end of the contemplated period of timing, the fuse 12 ignites the first ejection charge 15 which in its turn ignites the delay 16. The pressure created by the gases of the first ejection charge pushes against the container formed by the parts 17, 18 and 21, the connection between the shell body 13 and the base 14 is broken, the base is ejected and the shell body empties itself. FIG. 4 illustrates the start of this first phase. Upon its emergence, the small parachute 23 opens and starts to decelerate the container in translation. When the brakes 19 free themselves from the body of the shell, they also open up and assure a partial braking of rotation of the container.

Figure 5:
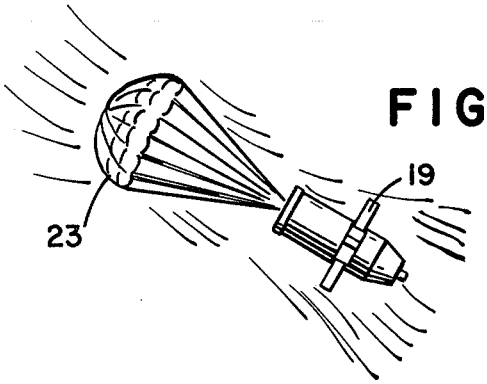

FIG. 5 shows the container/small parachute assembly during this first phase of operation which lasts about three seconds. At the end of this time, the speeds of rotation and of translation have sufficiently decreased to permit passage to the second operating phase without the risk of tearing the large parachute 30 at the time of its opening (reduction of the speed of translation) while relieving the fins 29 (reduction of the speed of rotation).

Thus, about three seconds after the first ejection, the delay 16 ignites the second ejection charge 25 which in its turn ignites the illuminating composition 28 while pushing against the piston 26. The pins 22 are then sheared and the container empties itself of its contents. The small parachute 23 connected to the bottom of the container 21 follows one trajectory and the container follows another while the large parachute 30 opens after the shells 32 have moved away. The illuminating flare 27 is therefore retarded in translation by the large parachute 30 and in rotation by the floating fins 29 which move apart upon their emergence from the container, sliding along the flexible cable 33 to come against the stop ring 35.

Figure 6:
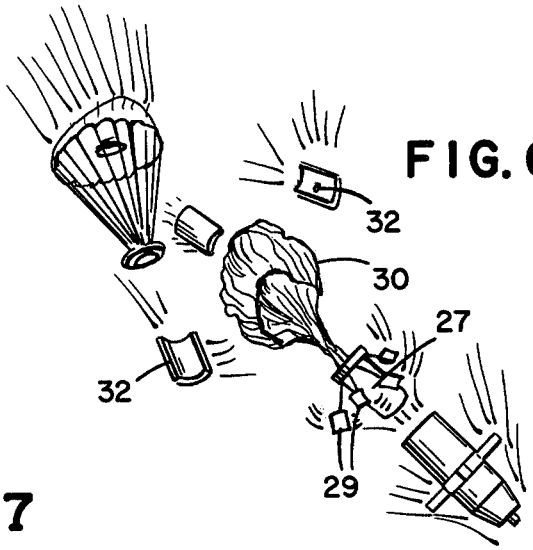
Figure 7:
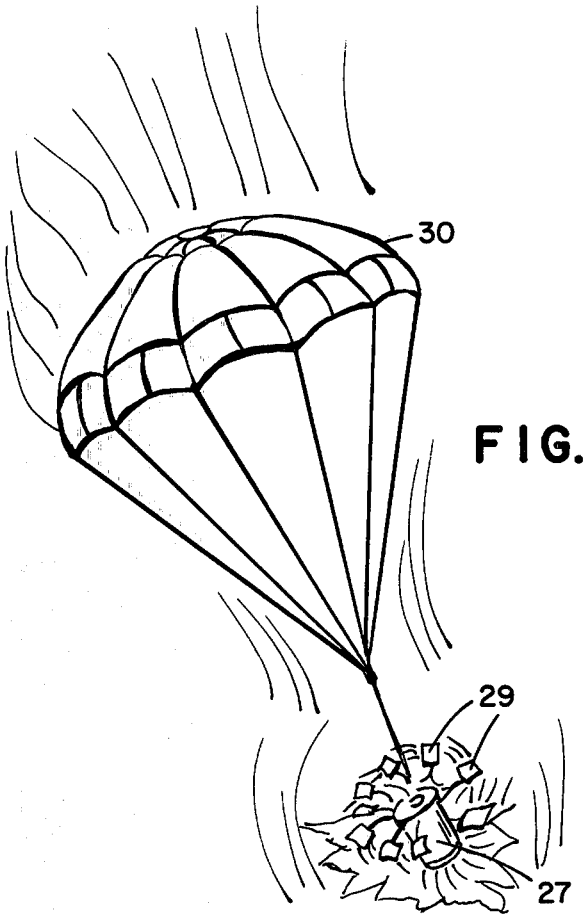

The ball bearing 31 prevents the twisting of the parachute suspension lines and the snaking thereof. The fins act until the complete stopping of rotation; thereupon they fold themselves over onto the flare where, in a preferred embodiment in which the fins are made of a fusable material, they are destroyed by the heat liberated by the combustion of the illuminating composition. FIG. 6 shows the start of the second phase and FIG. 7 its completion.

The fins of the device in accordance with the invention for the reduction of the speed of rotation of the illuminating flare, must be light in order not to break the connections at the time of deployment, particularly if the speed of rotation is very high. In a preferred embodiment, they are of injected polyethylene, but any other plastic material may be suitable or even a light metal such as magnesium may be used. Still in a preferred embodiment, the flexible connecting elements are formed of metal cables of high mechanical strength but in certain cases one may content oneself with connections of textile.

As can be noticed from FIG. 2, the connecting elements are fastened uniformly around the rear lateral part of the illuminating flare. As shown in FIG. 8, it has been found furthermore that by arranging the points of attachment of the connecting elements as straight saw teeth around the side wall of the flare, that is to say by staggering them alternately forward and rearward, the braking of rotation is improved.

In principle, a single braking of the illuminating flare by floating fins is sufficient to improve the photometric efficiency. However, it is at times necessary to have recourse to a double braking in the same way as for other reasons it is necessary to have recourse to a double ejection. In this case the second braking is assured by the floating fins acting directly on the illuminating flare while the first braking may be assured by conventional fins pivoting around an axis.

What is claimed is:

1. An illuminating projectile adapted to be launched by a rifled-tube unit, comprising:
   a. a body;
   b. a container releaseably connected to said body;
   c. a first ejection charge means for disconnecting said container from said body after a predetermined period of time, said container being subjected to rotational and translational movement after being disconnected from said body;
   d. a small parachute, connected to said container, for braking the translational movement of said container;
   e. first means, connected to and acting on said container, for reducing the rotational speed of said container;
   f. an illuminating flare releaseably connected to said container;
   g. a second ejection charge means for disconnecting said illuminating flare from said container after a predetermined period of time, said illuminating flare being subjected to residual rotational and translational movement after being disconnected from said container;
   h. a large parachute, connected to said illuminating flare, for braking the residual translational movement of said illuminating flare; and
   i. second means, connected to and acting on said illuminating flare, for reducing the residual rotational speed of said illuminating flare.

2. An illuminating projectile according to claim 1 wherein said second means for reducing comprises:
   a. a plurality of floating fins;
   b. a plurality of filiform elements connecting said floating fins to said illuminating flare, one end of each of said filiform elements being secured to said illuminating flare and the other end of each of said filiform elements being free; and
   c. a stop connected to said other end of each of said filiform elements, wherein said fins are mounted for free rotation and translation around and along said filiform elements.

3. A device for the reduction of the speed of rotation of an illuminating flare of an illuminating projectile launched from a rifled-tube unit, comprising:
   a. a plurality of floating fins;
   b. a plurality of filiform elements connected to said floating fins and adapted to connect said floating fins to the illuminating flare, one end of each of said filiform elements being securable to the illuminating flare, the other end of each of said filiform elements being free; and
   c. a stop connected to said other end of each of said filliform elements, wherein said fins are mounted for free rotation and translation around and along said filiform elements.

4. A device according to claim 3 wherein said filiform elements are flexible.

5. A device according to claim 3 wherein each of said fins is free in rotation and translation with respect to a single filiform element.

6. A device according to claim 3 wherein the illuminating flare has a rear side wall and wherein the one ends of said filiform elements include points of attachment arranged regularly around the rear side wall of the illuminating flare.

7. A device according to claim 6 wherein said points of attachment are arranged as straight saw teeth around the rear side wall of the illuminating flare.

8. A device according to claim 3 wherein said fins are cylindrical and have a curvature close to that of the illuminating flare.

9. A device according to claim 3 wherein said fins are formed of a readily fusable material.

10. A device according to claim 9 wherein said fusable material is a plastic material.

11. A device according to claim 10 wherein said plastic material is injected polyethelene.

12. An illuminating projectile adapted to be launched from a rifled-tube unit, comprising:
   a. a body;
   b. an illuminating flare releaseably connected to said body;
   c. an ejection charge means for disconnecting said illuminating flare from said body after a predetermined period of time, said illuminating flare being subjected to rotational and translational movement after being disconnected from said body;
   d. a parachute, connected to said illuminating flare, for braking the translational movement of said illuminating flare; and e. means, acting on said illuminating flare, for reducing the rotational speed of said illuminating flare, including a plurality of floating fins, a plurality of filiform elements connected to said floating fins and connecting said floating fins to said filiform elements, one end of each of said filiform elements being secured to said illuminating flare and the other end of each of said filiform elements being free, and a stop connected to said other end of each of said filiform elements, wherein said fins are mounted for free rotation and translation around and along said filiform elements.

13. A method of launching an illuminating projectile from a rifled-tube unit in which the projectile includes a body, an illuminating flare, an ejection charge, a parachute and means for reducing the speed of rotation of the illuminating flare, comprising:

a. forming said means for reducing of a plurality of floating fins;

b. connecting the fins to the illuminating flare by filiform elements having one end secured to the illuminating flare and the other end free;

c. providing a stop at the other end of the filiform elements;

d. mounting the fins for free rotation and translation around and along the filiform elements;

e. igniting the ejection charge after a predetermined period of time;

f. disconnecting the illuminating flare from the body under the action of the ejection charge to free the flare from the body;

g. braking translational motion of the illuminating flare with the parachute; and h. reducing the speed of rotation of the illuminating flare after the flare is freed from the body.

* * * * *